US009656313B2

(12) United States Patent
Fujii et al.

(10) Patent No.: US 9,656,313 B2
(45) Date of Patent: May 23, 2017

(54) ORIGINAL PLATE MATERIAL FOR HEAT-EXCHANGING PLATE, AND METHOD FOR FABRICATING ORIGINAL PLATE MATERIAL FOR HEAT-EXCHANGING PLATE

(75) Inventors: Yasuyuki Fujii, Kobe (JP); Akio Okamoto, Shinagawa-ku (JP); Yoshio Itsumi, Kakogawa (JP); Akihisa Fujita, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 1192 days.

(21) Appl. No.: 13/643,715

(22) PCT Filed: Apr. 27, 2011

(86) PCT No.: PCT/JP2011/060281

§ 371 (c)(1),
(2), (4) Date: Oct. 26, 2012

(87) PCT Pub. No.: WO2011/136278

PCT Pub. Date: Nov. 3, 2011

(65) Prior Publication Data

US 2013/0037246 A1 Feb. 14, 2013

(30) Foreign Application Priority Data

Apr. 28, 2010 (JP) ..... 2010-103525

(51) Int. Cl.
*B21C 37/00* (2006.01)
*B21D 13/04* (2006.01)
(Continued)

(52) U.S. Cl.
CPC ..... *B21D 13/04* (2013.01); *B21D 53/02* (2013.01); *F28F 3/04* (2013.01); *F28F 21/08* (2013.01); *B21D 53/04* (2013.01); *Y10T 29/4935* (2015.01)

(58) Field of Classification Search
CPC ..... B21D 13/04; B21D 13/10; B21D 22/04; B21D 53/02; B21D 53/04; F28F 3/04;
(Continued)

(56) References Cited

U.S. PATENT DOCUMENTS

2003/0136547 A1* 7/2003 Gollan ..... C25D 5/022 165/104.21
2006/0185835 A1 8/2006 Matsuzaki et al.
2012/0052241 A1* 3/2012 King ..... B08B 17/06 428/141

FOREIGN PATENT DOCUMENTS

EP 2123421 * 11/2009 ..... B29C 45/14
JP 2005 298930 10/2005
(Continued)

OTHER PUBLICATIONS

International Search Report Issued Aug. 16, 2011 in PCT/JP11/60281 Filed Apr. 27, 2011.
(Continued)

*Primary Examiner* — Humera Sheikh
*Assistant Examiner* — Seth Dumbris
(74) *Attorney, Agent, or Firm* — Oblon, McClelland, Maier & Neustadt, L.L.P.

(57) ABSTRACT

An original plate material for a heat-exchanging plate fabricated by press working and a method for fabricating the original plate material are provided. An original plate material for a heat-exchanging plate is a flat plate material made of titanium on the surface of which convex parts and concave parts are formed, and the heat-exchanging plate is fabricated by press working the original plate material. The convex parts and the concave parts are formed in a manner such that the shape parameter defined by (Rz×L/P) is 12 μm or less, where Rz (μm) denotes the height of the convex
(Continued)

parts, L (μm) denotes the width of the concave parts, and P (μm) denotes the pitch between neighboring convex parts.

7 Claims, 5 Drawing Sheets

(51) Int. Cl.

| | |
|---|---|
| ***F28F 3/04*** | (2006.01) |
| ***F28F 21/08*** | (2006.01) |
| ***B21D 53/02*** | (2006.01) |
| *B21D 53/04* | (2006.01) |

(58) Field of Classification Search
CPC ..... F28F 3/044; F28F 21/08; F28F 21/081; F28F 21/086; F28F 3/042; F28F 3/046; Y10T 428/1241; Y10T 428/12417; Y10T 428/12993; Y10T 428/12472
USPC ..... 428/603, 604, 612
See application file for complete search history.

(56) References Cited

FOREIGN PATENT DOCUMENTS

| | | |
|---|---|---|
| JP | 2005-298930 | 10/2005 |
| JP | 2005-337643 | 12/2005 |
| JP | 2006 214646 | 8/2006 |
| JP | 2006 239744 | 9/2006 |
| JP | 2009 136893 | 6/2009 |
| JP | 2009 192140 | 8/2009 |

OTHER PUBLICATIONS

Japanese Office Action issued Aug. 6, 2013, in Japan Patent Application No. 2011-216957 (with English translation).
Office Action issued Aug. 9, 2011 in Japanese Application No. 2010-103525 (With English Translation).

* cited by examiner (a)

(b)

ORIGINAL PLATE MATERIAL FOR HEAT-EXCHANGING PLATE, AND METHOD FOR FABRICATING ORIGINAL PLATE MATERIAL FOR HEAT-EXCHANGING PLATE

TECHNICAL FIELD

The present invention relates to an original plate material for a heat-exchanging plate, and a method for fabricating the original plate material for a heat-exchanging plate.

BACKGROUND ART

There has been a need of heat-exchanging plates, which are incorporated in heat-exchangers and the like, having high heat conductivity. In order to improve heat conductivity, it is desirable that the surface areas of the plates be increased by forming a fine recess and projections in the order of micrometers on the surfaces of the plates. As a method for transferring a fine recess and projections in the order of micrometers, a technology as described in, for example, Patent Literature 1 has been developed.

In the method for transferring to the surface of a metal plate described in Patent Literature 1, a transfer portion having a recess and projections formed on the outer peripheral surface of a transfer roller is pressed against a metal sheet, which is transported by rotation of transport rollers. Thus, a transferred portion having recessed and projecting shapes substantially similar to those of the transfer portion of the transfer roller is formed on the surface of the metal sheet.

Patent Literature 2 discloses a plate-type heat exchanger. In this plate-type heat exchanger, plate sets and bulkhead plates are alternatingly stacked. The plate sets each are formed of two plates, which each have a row of openings arranged in a specified pattern, are superposed on each other such that the rows of openings of the two plates cross each other. The bulkhead plates each have communication holes at four corners thereof. The plate-type heat exchanger is disclosed, in which circulation layers for a fluid are defined by the bulkhead plates and each of the circulation layers stacked in an up-down direction communicates with the every other circulation layers. In order to improve heat conductivity and strength, a heat-exchanging plate used for the heat exchanger has, for example, chevron-shaped grooves known as "herring-bone" having a height of smaller than 10 mm to smaller than 10 cm press-formed thereon. After that, the heat-exchanging plate is incorporated in the heat exchanger.

CITATION LIST

Patent Literature

PTL 1: Japanese Unexamined Patent Application Publication No. 2006-239744

PTL 2: Japanese Unexamined Patent Application Publication No. 2009-192140 (for example, FIG. 6)

SUMMARY OF INVENTION

Technical Problem

In the heat-exchanging plate disclosed in Patent Literature 1, the surface area of the flat plate material is increased by forming a fine recess and projections in the order of micrometers on the surface of the flat plate material, thereby improving heat conductivity. However, in few cases the flat plate material having a fine recess and projections formed on the surface thereof as it is used as the heat-exchanging plate.

That is, as disclosed in FIG. 6 of Patent Literature 2, the flat plate material having a fine recess and projections is typically has, for example, chevron-shaped grooves known as "herring-bone" having a height of smaller than 10 mm to smaller than 10 cm press-formed on the flat surface thereof. After that, the flat plate material is incorporated in a heat exchanger. Thus, it is desirable that the flat plate material having a fine recess and projections formed thereon have press formability.

Furthermore, in some cases, the flat plate material is formed of titanium. Titanium is a material having anisotropy. The anisotropy of a material affects its deformation behavior such as a decrease in thickness or strain gradient in a portion where stress is concentrated. For this reason, titanium has significantly poor press formability and the like compared to other materials not having anisotropy. Furthermore, since titanium easily causes seizure, the material tends to break or become scratched due to contact with a mold for pressing or a tool when lubricant film breakdown occurs while being pressed.

Naturally, Patent Literatures 1 or 2 does not disclose a technology for fabricating heat-exchanging plates with which difficulties caused by titanium flat plate materials have been overcome.

The present invention is proposed in view of the above-described problem. An object of the present invention is to provide an original plate material for a heat-exchanging plate, which has a significantly good heat conductivity and can be easily formed into a heat-exchanging plate, and a method for fabricating this original plate material.

Solution to Problem

In order to achieve the above-described object, the present invention includes the following technical means.

That is, an original plate material for a heat-exchanging plate according to the present invention is an original plate material formed by making a fine recessed part and fine projecting parts on a surface of a titanium flat plate material. The original plate material is subject to press working so as to be used as a heat-exchanging plate. In the original plate material, the recessed part and the projecting parts are formed such that, when a height of the projecting parts is Rz (μm), a width of the recessed part is L (μm), and a pitch between the projecting parts adjacent to each other is P (μm), a shape parameter defined by (Rz×LIP) is 12 (μm) or smaller.

Preferably, the recessed part and the projecting parts are formed such that the shape parameter is 4 μm or greater.

Preferably, the projecting parts each have a circular shape in plan view, and the projecting parts are formed so as to be arranged in a staggered manner on the surface of the flat plate material.

Preferably, the height Rz of the projecting parts obtained as a ten-point average roughness is 5 μm or greater and equal to or smaller than 0.1×t (μm), where t (μm) is a thickness of the flat plate material.

A method of fabricating an original plate material for a heat-exchanging plate according to the present invention is a method for fabricating an original plate material formed by making a fine recessed part and fine projecting parts on a surface of a titanium flat plate material. The original plate material is subject to press working so as to be used as a heat-exchanging plate.

In the original plate material, the recessed part and the projecting parts are formed such that, when a height of the projecting parts is Rz (μm), a width of the recessed part is L (μm), and a pitch between the projecting parts adjacent to each other is P (μm), a shape parameter defined by (Rz×L/P) is 12 μm or smaller.

Preferably, the recessed part and the projecting parts are formed such that the shape parameter is 4 μm or greater.

Preferably, each projecting part is formed so as to have a circular shape in plan view, and the projecting parts are formed so as to be arranged in a staggered manner on the surface of the flat plate material.

Preferably, the projecting parts are formed on the surface of the flat plate material such that the height Rz of the projecting parts obtained as a ten-point average roughness is 5 μm or greater and equal to or smaller than 0.1×t (μm), where t (μm) is a thickness of the flat plate material.

Advantageous Effects of Invention

With the original plate material according to the technology of the present invention, breakage or the like does not occur during press working as a downstream process and the heat-exchanging plate can be easily fabricated. Furthermore, since the recessed part and the projecting parts are formed on the surface of the original plate material, a heat-exchanging plate having a significantly good heat conductivity can be fabricated.

DESCRIPTION OF EMBODIMENT

An embodiment of the present invention will be described below with reference to the drawings.

Figure 1:
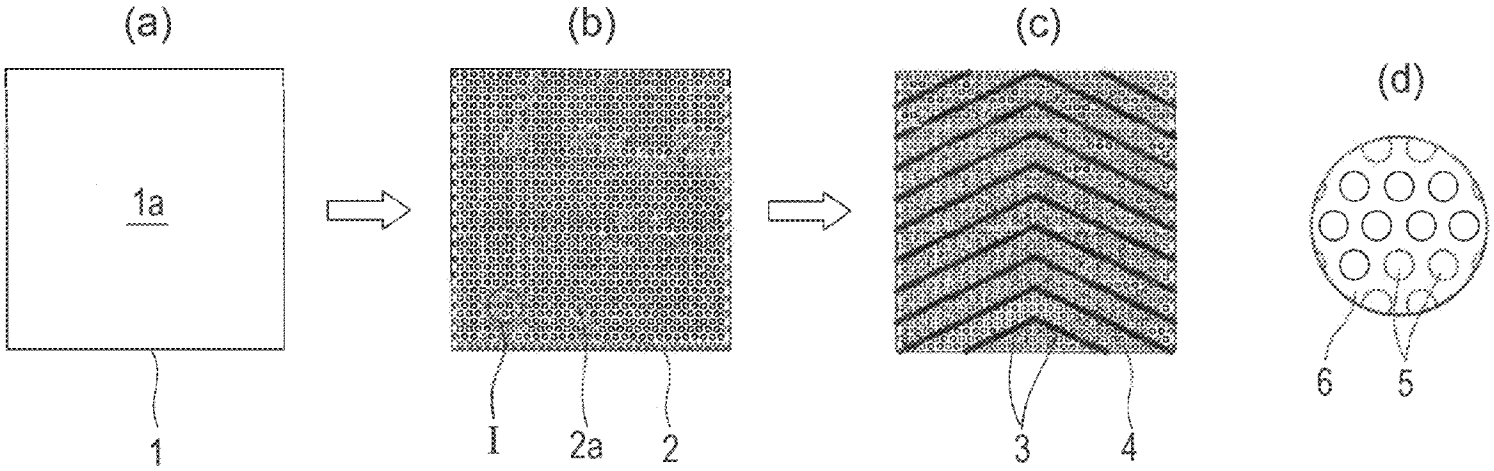
FIG. 1 includes views (a) to (c), which illustrate a method for fabricating a heat-exchanging plate, and includes view (d), which is an enlarged view of part I in (b).

FIG. 1 is a conceptual view illustrating a method for fabricating a heat-exchanging plate.

In order to fabricate the heat-exchanging plate, as illustrated in FIG. 1 (*a*), a flat plate material 1 as a raw material having a specified size is initially prepared. As illustrated in FIG. 1 (*b*), the flat plate material 1 is pressed so as to form fine recessed and projecting shapes on a surface 1*a* of the flat plate material 1, thereby producing a plate raw sheet 2 (original plate material) having fine recessed and projecting shapes formed on a surface 2*a*. Next, as illustrated in FIG. 1 (*c*), the plate raw sheet (original plate material) is pressed so as to form, for example, chevron-shaped grooves (herring-bone) 3. Thus, a heat-exchanging plate 4 is fabricated.

The flat plate material 1 illustrated in FIG. 1 (*a*) is made of titanium, and the dimensions and thickness thereof are determined with consideration of dimensions and thickness desired for the heat-exchanging plate 4 as a finished product.

The plate raw sheet 2 is fabricated by forming fine recessed and projecting shapes (made of a plurality of projecting parts 5 and a recessed part 6 interposed therebetween) using a process device 10, which will be described later, on the surface 1*a* of the flat plate material 1. The plate raw sheet 2 having the recessed and projecting shapes formed thereon has a significantly improved heat conductivity and a significantly high heat transfer coefficient. In addition, the plate raw sheet 2 according to the present invention is made of titanium, the characteristics of which such as corrosion resistance and strength are good and the weight of which is light compared to other metal materials. Thus, the plate raw sheet 2 is preferably used in products for which corrosion resistance and strength are required such as a plate for a plate-type heat exchanger.

The herring-bone 3 includes a plurality of grooves, which appear like a skeleton shape, and the height of the grooves is from less than 10 mm to less than 10 cm. The raw sheet 2 is incorporated in a heat exchanger. Even when a flow of a working fluid in the heat exchanger is not uniform, inclined grid like recesses and projections, typical examples of which include the herring-bone 3, can serve as walls perpendicular to the working fluid flowing from any direction, and accordingly, contribute to improvement of heat conductivity due to turbulence.

The details of the recessed and projecting shapes on the surface of the plate raw sheet 2 will be described below.

Figure 2:
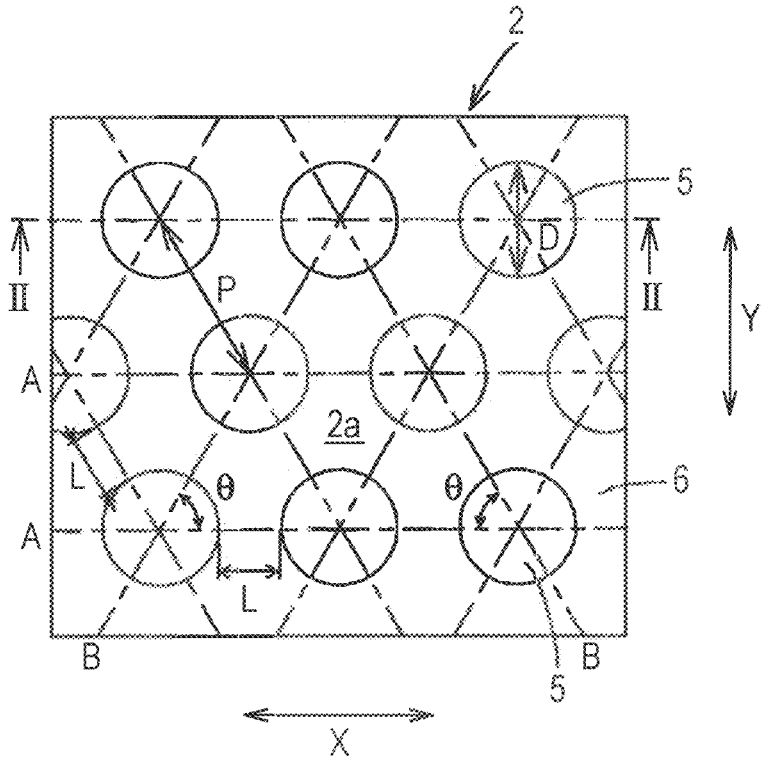
FIG. 2 includes views of a recessed part and projecting parts formed on a surface of an original plate material, and out of the views, view (a) is a plan view and view (b) is a sectional view taken along line II-II in view (a).
Figure 2:
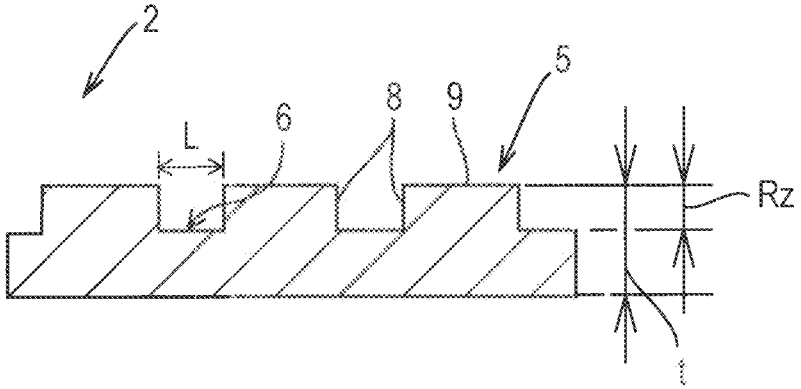

As illustrated in FIG. 2 (*a*), the projecting parts 5 formed on the surface 2*a* of the plate raw sheet 2 each have a circular shape in plan view and a diameter D of equal to or greater than 400 μm. The projecting parts 5 are arranged in a staggered manner in plan view. Here, arrangement in a staggered manner (staggered arrangement) means that a line connecting the centers of the projecting parts 5 adjacent to each other in a lateral direction (X-direction) is not perpendicular to a line connecting the centers of the projecting parts 5 adjacent to each other in a vertical direction (Y-direction). Also, the term "adjacent to" here means being spaced apart by a shortest distance.

Specifically, as illustrated in FIG. 2 (*a*), the projecting parts 5 adjacent to each other in the vertical direction (Y-direction) are shifted to each other by a half pitch in the lateral direction (X-direction) in the plate raw sheet 2. Here, the projecting parts 5 are arranged such that a line (dotted-chain line) A connecting the centers of the adjacent projecting parts 5 to each other in the lateral direction (X-direction) forms an angle θ of 60° with a line (dotted-chain line) B connecting the centers of the adjacent projecting parts 5 to each other in the vertical direction (Y-direction).

Since the projecting parts 5 are arranged in a staggered manner as described above, even when a flow of a working fluid in the heat exchanger is not uniform, the projecting parts 5 can serve as walls perpendicular to the working fluid flowing from any direction, and accordingly, contribute to improvement of heat conductivity due to turbulence. Furthermore, since the projecting parts 5 are arranged in a staggered manner, even when the projecting parts 5 are formed of titanium or other materials having anisotropy, concentration of stress due to anisotropy can be addressed.

Preferably, the distance L between the projecting parts 5 (width L of the recessed part 6) adjacent to each other in the vertical or lateral direction is 200 μm or greater. Here, the width L of the recessed part 6 means the shortest distance between the projecting parts 5 adjacent to each other in the lateral or vertical direction. When the pitch between the adjacent projecting parts 5 is P and the diameter of the projecting parts 5 is D, the width of the recessed part 6 can be obtained by the following equation:

$$L=P-(D/2)\times 2.$$

Here, the pitch P between the adjacent projecting parts 5 means the distance between the centers of the projecting parts 5 adjacent to each other in the lateral or vertical direction (distance between the centers of the projecting parts 5 spaced apart from each other by the shortest distance).

The width L of the recessed part 6 illustrated in FIG. 2 (*a*) is the same in the vertical and lateral directions. That is, the shortest distance between the projecting parts 5 adjacent to each other in the vertical direction and the shortest distance between the projecting parts 5 adjacent to each other in the lateral direction are the same. Preferably, the pitch P between the adjacent projecting parts 5 (distance between the centers of the adjacent projecting parts 5) is 600 μm or greater.

As illustrated in FIG. 2 (*b*), the projecting parts 5 each have a trapezoidal shape in sectional view having an upper wall 8 that extends upward and a front wall 9 that connects upper edge of the upper wall 8 in a horizontal direction. The height of the projecting parts 5 (upper walls 8) expressed as ten-point average roughness Rz (may also be referred to as height Rz hereafter) is 5 μm or greater, and equal to or smaller than one tenth of the thickness t of the plate raw sheet 2, that is, equal to or smaller than 0.1×t.

The above-described range of the height Rz of the projecting parts 5 is determined since, when the projecting parts are too large relative to the thickness, during roll transfer using the process device 10, which will be described later, flatness (shape) cannot be ensured, and accordingly, stability in rolling cannot be obtained. Furthermore, when a plate is press-formed in a downstream process, if the flatness of the plate is not ensured, stress distribution occurs and the plate breaks in portions of the plate where stress is higher. That is, the projecting parts 5 having an excessively large height Rz cause (become the starting points of) breaks in press working and cause scratches. In contrast, when the height Rz is too small (5 μm or smaller), the heat transfer coefficient cannot be improved.

The projecting part 5 does not necessarily have a perfect circle in plan view. The shape of the projecting part 5 in plan view may be an ellipse, with a flattening of up to about 0.2. Although, the projecting part 5 having a polygonal shape in plan view also seems possible, the projecting part 5 preferably has a substantially circular shape from the viewpoint of avoiding concentration of stress in press working to be performed in a downstream process. Arrangement of the projecting parts 5 is not limited to a shape illustrated in FIG. 2.

Figure 3:
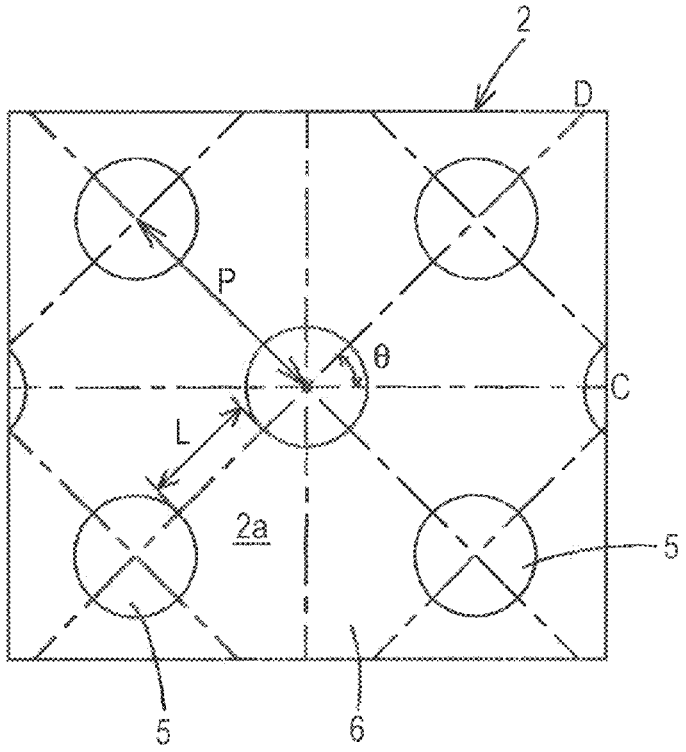
FIG. 3 illustrates another example of a recessed part and projecting parts formed on the surface of the original plate material.

For example, as illustrated in FIG. 3, the projecting parts 5 may be arranged such that a line (dotted-chain line) C connecting the centers of the adjacent projecting parts 5 to each other in the lateral direction (X-direction) forms an angle θ of 45° with a line (dotted-chain line) D connecting the centers of the adjacent projecting parts 5 to each other in the vertical direction (Y-direction). The angle θ may be other than 45°.

In fabrication of the plate raw sheet 2, the inventors focused on a shape parameter [Rz×(L/P)] in order to optimize the height Rz of the projecting parts 5 formed on the surface of the plate raw sheet 2, the shortest distance (width L of the recessed part 6) between the adjacent projecting parts 5, and the pitch P between the adjacent projecting parts 5.

Figure 4:
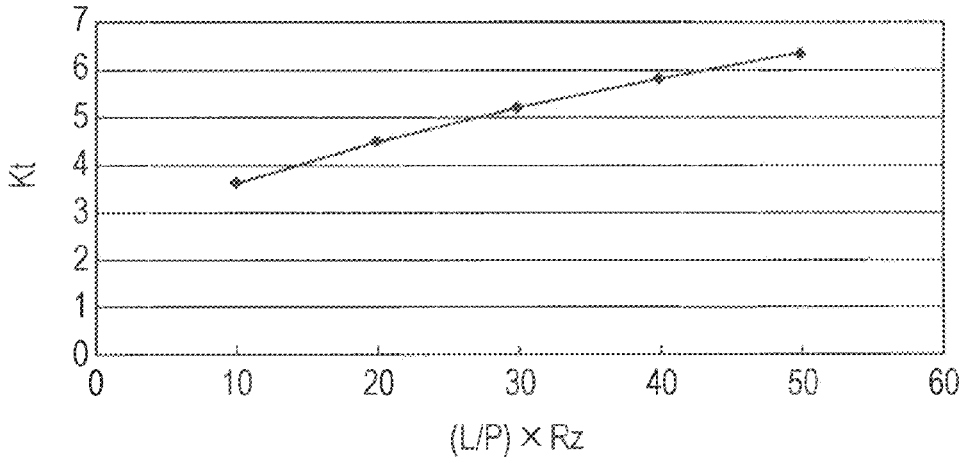
FIG. 4 illustrates the relationship between L/P and the ratio of concentration of stress.

Initially, in the above-described shape parameter, when it is assumed that the height Rz of the projecting parts 5 is fixed and (width L of recessed part 6/pitch P of adjacent projecting parts) is changed, as illustrated in FIG. 4, the ratio of concentration of stress Kt tends to increase as L/P increases. When the ratio of concentration of stress Kt is high, breakage easily occurs and formability is low. In contrast, when the ratio of concentration of stress Kt is low, breakage is unlikely to occur and formability is high. That is, excessively large width L of the recessed part 6 or excessively small pitch P between the projecting parts leads to concentration of stress, thereby allowing breakage to easily occur at such time as when press-forming (press working in which the herring-bone or the like is formed) is performed.

In the above-described shape parameter, when the height Rz of the projecting parts 5 is increased, similarly to the case where the width L of the recessed part 6 or the pitch P between the adjacent projecting parts 5 is changed, stress may be unevenly distributed and breakage may occur in portions where stress is higher when press-forming is performed.

Accordingly, with consideration of press formability of the plate raw sheet 2, it is thought to be optimum that the height Rz of the projecting parts 5 or the width L of the recessed part 6 is not excessively large and the pitch P between the projecting parts is not excessively small. Thus, the shape parameter that represents these is thought to have an upper limit.

The inventors performed computer simulation on the titanium plate raw sheets 2 having a variety of shapes of recesses and projections formed thereon so as to clarify the relationship between the shape parameter [Rz×(L/P)] and a press formability score Pf.

Figure 7:
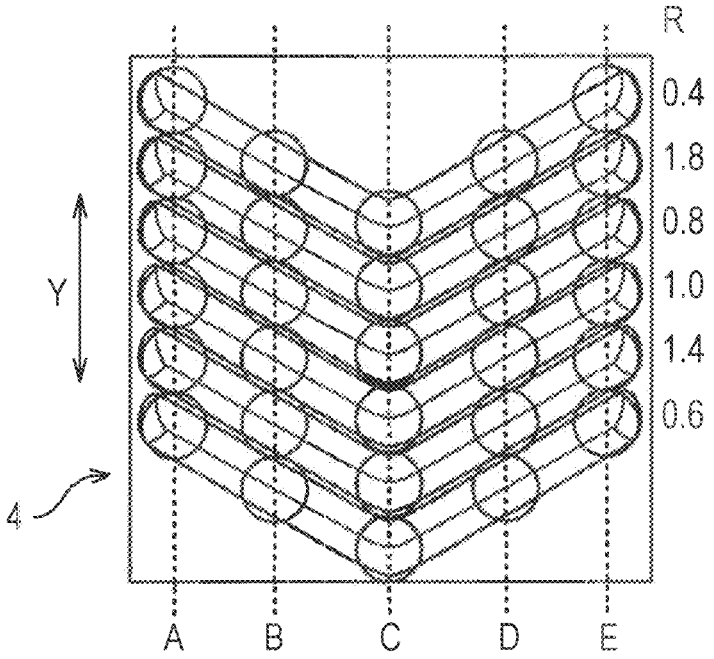
FIG. 7 is a reference diagram for calculation of the press formability score Pf.

Here, the "press formability score" (Pf) is an index used to evaluate formability in press working. When the value of the press formability score Pf is 60 points or greater, it is regarded that no breakage or the like due to press-forming does not occur and a desired shape can be reliably obtained. In the present embodiment, as illustrated in FIG. 7, the heat-exchanging plate 4 having been formed (pressed) is graded at 30 positions with the points, and the press formability score Pf is calculated by tabulating these scores.

In particular, in the heat-exchanging plate 4, in each of the positions that intersects one of lines A, C, and E extending in the vertical direction (Y-direction), if occurrence of breakage is not observed and the portion of the heat-exchanging plate 4 at the position is in a good state, the portion of the heat-exchanging plate 4 at the position is given a grade of 2 points; if a tendency of necking is observed, the portion of the heat-exchanging plate 4 at the position is given a grade of 1 point; and if occurrence of breakage is observed, the portion of the heat-exchanging plate 4 at the position is given a grade of 0 points. In each of the positions that intersects one of lines B and D extending in the vertical direction (Y-direction), if the portion of the heat-exchanging plate 4 at the position is in a good state, the portion of the heat-exchanging plate 4 at the position is given a grade of 1 point; if a tendency of necking is observed, the portion of the heat-exchanging plate 4 at the position is given a grade of 0.5 point; and if occurrence of breakage is observed, the portion of the heat-exchanging plate 4 at the position is given a grade of 0 points. States of breakage are numerically expressed by multiplying the grading point given to each portion by the inverse of a corresponding one of R values listed in FIG. 7. Then, the ratio of non-breakage to the total points is calculated. The resultant value represents the press formability score Pf.

Figure 5:
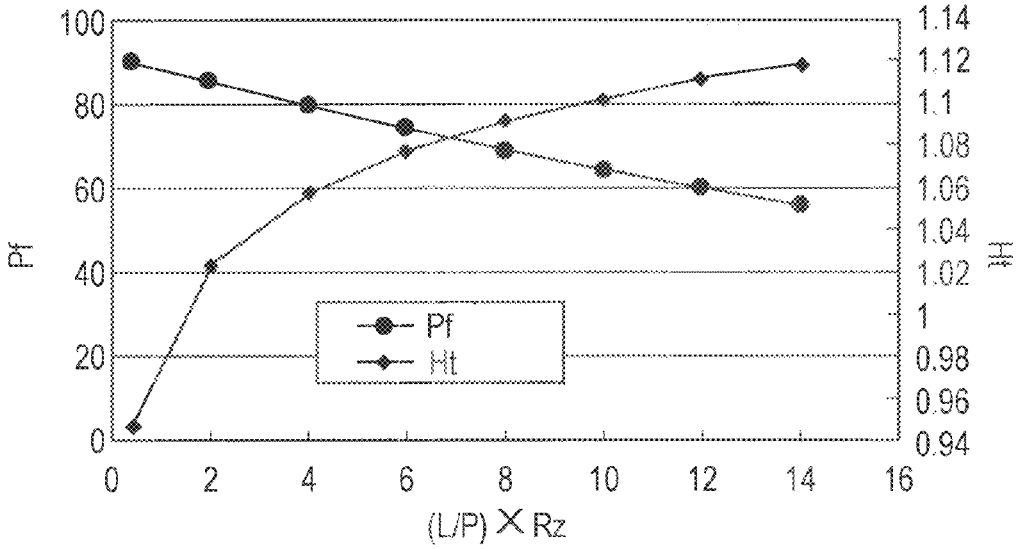
FIG. 5 illustrates the relationship between heat transfer efficiency and the dimensions and shapes of the recessed part and the projecting parts formed on the surface of the original plate material, and the relationship between a press formability score and the dimensions and shapes of the recessed part and the projecting parts formed on the surface of the original plate material.

FIG. 5 illustrates the relationship between the shape parameter and the press formability score Pf. As illustrated in FIG. 5, as the shape parameter increases, the press formability score decreases. However, when the shape parameter is 12 μm or smaller, the press formability score Pf is equal to or more than 60 points. That is, when the shape parameter is 12 μm or smaller, lowering of the press formability score Pf can be avoided.

The plate raw sheet 2 according to the present invention is a material of a plate that is part the heat exchanger, specifically, a material processed to form a bulkhead for exchanging heat. Thus, the plate raw sheet 2 according to the present invention is also required to have a large heat transfer coefficient (large heat transfer efficiency).

The heat transfer efficiency of a flat plate without recessed or projecting parts formed thereon is assumed to be 1.00, and the heat transfer efficiency of a plate (heat-exchanging plate) with recessed and projecting parts formed thereon is given by Ht. The heat transfer efficiency Ht of the heat-exchanging plate is required to be greater than 1.00, and in order to produce a significant effect in an actual heat exchanger, it is preferable that the heat transfer efficiency Ht be 1.05 or greater.

Here, the relationship between the heat transfer efficiency Ht and the shape parameter is described. As illustrated in FIG. 5, for example, when the height Rz of the projecting part 5 or the width L of the recessed part 6 is decreased, or the pitch P between the projecting parts is increased, the shape parameter gradually decreases from 12 μm. As the shape parameter gradually decreases as described above, the heat transfer efficiency also gradually decreases. This makes the heat transfer efficiency become closer to that of the flat plate without the recessed or projecting parts formed thereon. However, when the shape parameter is 4 μm or greater, the heat transfer efficiency required for the actual heat exchanger (1.05 or greater) can be ensured.

Thus, from the viewpoint of the heat transfer efficiency, it is preferable that the shape parameter be 4 μm or greater when fabricating the plate raw sheet 2.

As the width L of the recessed part 6 is decreased, the shape parameter decreases. When thinking from the viewpoint of a thermal boundary layer in the case where a fluid flows, the recessed part 6 having an excessively small width L causes heat conductivity to be decreased. Thus, it is thought to be desirable that the width L of the recessed part 6 of a certain degree of size be ensured, and it is thought to be necessary that the shape parameter of a certain degree of magnitude be ensured.

As described above, from the viewpoint of the relationship between the width L of the recessed part 6 and the thermal boundary layer, a shape parameter of a certain degree of magnitude needs to be ensured. Specifically, as described above, a shape parameter of 4 μm or greater is thought to be required.

As described above, the shape parameter is set to a value in the range between 4 μm to 12 μm, and the height Rz of the projecting parts 5 obtained as ten-point average roughness is 5 μm or greater and equal to or smaller than 0.1×t (μm) with respect to the thickness t of the flat plate material. With these settings, the width L of the recessed part 6 and the pitch P between the projecting parts 5 are automatically determined (derived).

In addition, in order to prevent deformation of the projecting parts 5 and for workability in press working to be performed in a downstream process, it is preferable the ratio S of pressure contact areas satisfy an expression (1) in the plate raw sheet 2 having the recessed part 6 and the projecting parts 5 illustrated in FIG. 2 (*a*).

In addition, with consideration of prevention of deformation of the projecting parts 5 and workability in press working to be performed in a downstream process, it is preferable the ratio S of pressure contact areas in the plate raw sheet 2 satisfy the expression (1) for the recessed and projecting shapes illustrated in FIG. 2 (*a*).

Yield stress of flat plate material 1 (titanium) σy>bearing pressure (F/S) applied to the projecting parts 5 in pressing (1).

Here, $$S1=P\cdot P\cdot\tan(\theta/180\cdot\pi)/4$$

$$S2=\pi/4\cdot D\cdot D/2.$$

These are rewritten as follows:

$$S1=P^2\cdot\tan(\pi\theta/180)/4$$

$$S2=\pi D^2/8,$$

where

S=ratio of pressure contact areas=S2/S1

F=load in press working, and

D=diameter of projecting part 5.

The above-described S1 is an area of a plane in FIG. 2 (*a*) (area of a triangle surrounded by a line A and lines B in FIG. 2 (*a*)). The above-described S2 is an area of the projecting parts 5 in FIG. 2 (*a*) (area of the projecting parts 5 existing within the above-described triangle).

By using the titanium original plate material 2, on the surface of which the recessed part 6 and the projecting parts 5 are formed so as to have a shape parameter of 4 μm to 12 μm as described above, the heat-exchanging plate 4, which is part of the heat exchanger, can be fabricated without occurrence of breakage or the like during press working. The heat-exchanging plate 4 fabricated as described above has a heat exchanger effectiveness of 1.05 or greater and exhibits a significantly good heat conductivity. A heat exchanger in which this heat-exchanging plate 4 is incorporated has a significantly high heat exchanger efficiency.

Figure 6:
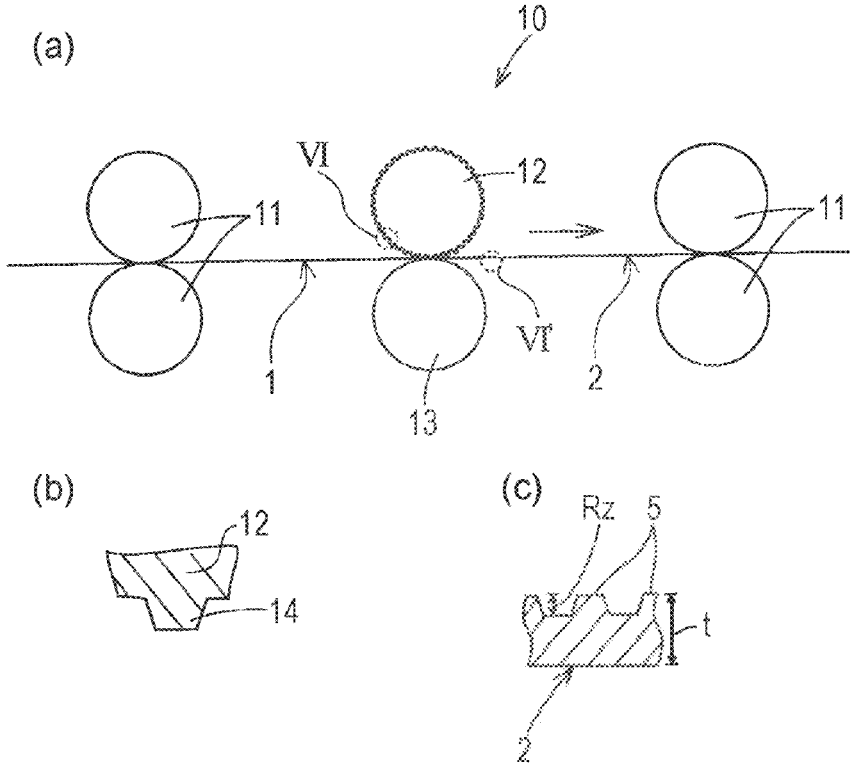
FIG. 6 includes view (a), which is an outline diagram of a device that forms the recessed part and projecting parts on the surface of the original plate material, view (b), which is an enlarged view of part W in view (a), and view (c), which is an enlarged view of part VI' in view (a).

The above-described plate raw sheet 2 can be formed using the process device 10 as illustrated in FIG. 6.

The process device 10 includes transport rollers 11, a process roller 12, and a support roller 13. The transport rollers 11 are disposed on the upstream side and the downstream side of the process roller 12 and transport the flat plate material 1.

The process roller 12 forms a recess and projections in the order of micrometers (smaller than 10 μm to smaller than one mm), on the surface of the flat plate material 1 being transported. Specifically, the process roller 12 forms the projecting parts 5 having a height of Rz and the pitch P and the recessed part 6 having a width of L on the surface 1*a* of the flat plate material 1 such that the shape parameter of the plate raw sheet 2 is from 4 μm to 12 μm.

A process portions 14 each having a projecting shape (a trapezoidal projection) are formed over a whole area of an outer peripheral surface of the process roller 12 by etching or electro-discharge texturing (see FIG. 6 (*b*)). The height of the process portions 14 is set such that the height Rz of the projecting parts 5 of the plate raw sheet 2 obtained after the process is 5 μm or greater and equal to or smaller than 0.1×t (μm), with respect to the thickness t of the flat plate material. It is desirable that the surface layer of the process roller 12 be Cr-plated or tungsten-carbide coated from the viewpoint of load bearing characteristics and wear resistance.

The process device 10 presses the process portions 14 provided on the process roller 12 against the surface of the flat plate material 1 while the process roller 12 is being rotated. By doing this, the recessed part 6, which is complementarily shaped with respect to the process portions 14, is formed on the surface of the flat plate material 1, thereby forming the projecting parts 5. Thus, with the process device 10, the shape parameter of the plate raw sheet 2 can be from 4 μm to 12 μm, the height Rz of the projecting parts 5 of the plate raw sheet 2 can be 5 μm or greater and 10% or smaller of the thickness t of the plate raw sheet 2 (see FIG. 6 (*c*)). The device used to form the projecting parts 5 is not limited to the above-described process device.

The embodiment disclosed herein is exemplary in every aspect and should be understood as non-limiting. It is intended that the scope of the present invention is defined not by the foregoing description but by the scope of the claims, and any modification within the scope of the claims or equivalent in meaning to the scope of the claims is included in the scope of the present invention.

For example, in the foregoing embodiment, the heat-exchanging plate 4 is fabricated in press working performed on the plate raw sheet 2. However, the press working may be any press working and not limited to the foregoing press working that forms the herring-bone.

The "press formability score", which is used as criterion for evaluating press formability in the present invention, is known to have a good correlation with the Erichsen value (Erichsen test), which is regarded as a general evaluation method for press formability. Thus, press formability can be correctly evaluated also with the press formability score used in the present invention.

The present application is filed on the basis of Japanese Patent Application No. 2010-103525 filed on Apr. 28, 2010, the contents of which are incorporated herein by reference.

INDUSTRIAL APPLICABILITY

The original plate material for a heat-exchanging plate according to the present invention is preferably used as a raw plate of a plate included in a heat exchanger, which is used for, for example, ocean power generation.

REFERENCE SIGNS LIST

1 flat plate material
1*a* surface of flat plate material
2 plate raw sheet (original plate material)
2*a* surface of plate raw sheet
3 groove
4 heat-exchanging plate
5 projecting part
6 recessed part
8 upper wall
9 front wall
10 process device
11 transfer roller
12 process roller
13 support roller

The invention claimed is:

1. An original plate material for a heat-exchanging plate, the original plate material comprising:

a recessed part and projecting parts on a surface of a titanium flat plate material, the original plate material being subject to press working so as to be used as a heat-exchanging plate, wherein the projecting parts are formed so as to be arranged in a staggered manner in plan view on the surface of the flat plate material such that a first line connecting centers of the projecting parts adjacent to each other in a lateral direction is not perpendicular to a second line connecting the centers of the projecting parts in a vertical direction, and wherein the recessed part and the projecting parts are formed such that, when a height of the projecting parts is Rz in μm, a width of the recessed part, defined as a shortest distance between the projecting parts adjacent to each other in the lateral or vertical direction, is L in μm, and a pitch, defined as a distance between the centers of the projecting parts adjacent to each other, is P in μm, a shape parameter defined by Rz×L/P is 4 μm to 12 μm.

2. The original plate material for a heat-exchanging plate according to claim 1, wherein the projecting parts each have a circular shape in plan view.

3. The original plate material for a heat-exchanging plate according to claim 2, wherein the width of the recessed part L is obtained by the following equation:

$$L=P-(D/2)\times 2,$$

where D is a diameter of the projecting parts.

4. The original plate material for a heat-exchanging plate according to claim 1, wherein each of the projecting parts includes a trapezoidal shape in sectional view having first and second upper walls that extend upwards and a front wall that connects upper edges of the upper walls in a horizontal direction.

5. The original plate material for a heat-exchanging part according to claim 1, wherein the projecting parts have a trapezoidal shape in a sectional view.

6. An original plate material for a heat-exchanging plate, the original plate material comprising:

a recessed part and projecting parts on a surface of a titanium flat plate material, the original plate material being subject to press working so as to be used as a heat-exchanging plate, wherein the projecting parts are formed so as to be arranged in a staggered manner in plan view on the surface of the flat plate material such that a first line connecting centers of the projecting parts adjacent to each other in a lateral direction is not perpendicular to a second line connecting the centers of the projecting parts in a vertical direction, wherein the recessed part and the projecting parts are formed such that, when a height of the projecting parts obtained as a ten-point average roughness is Rz in μm, a width of the recessed part, defined as a shortest distance between the projecting parts adjacent to each other in the lateral or vertical direction, is L in μm, and a pitch, defined as a distance between the centers of the projecting parts adjacent to each other, is P in μm, a shape parameter defined by Rz×L/P is 12 μm or smaller, and wherein the height Rz of the projecting parts is at least 5 μm, and equal to or smaller than 0.1×t in μm, where t (μm) is a thickness of the flat plate material.

7. An original plate material for a heat-exchanging plate, the original plate material comprising:

a recessed part and projecting parts on a surface of a titanium flat plate material, the original plate material being subject to press working so as to be used as a heat-exchanging plate, wherein the projecting parts are formed so as to be arranged in a staggered manner in plan view on the surface of the flat plate material such that a first line connecting centers of the projecting parts adjacent to each other in a lateral direction is not perpendicular to a second line connecting the centers of the projecting parts in a vertical direction, wherein the recessed part and the projecting parts are formed such that, when a height of the projecting parts is Rz in μm, a width of the recessed part, defined as a shortest distance between the projecting parts adjacent to each other in the lateral or vertical direction, is L in μm, and a pitch, defined as a distance between the centers of the projecting parts adjacent to each other, is P in μm, a shape parameter defined by Rz×L/P is 4 μm to 12 μm or smaller, and wherein the width of the recessed part L is 200 μm or more.

* * * * *